US011172801B2

(12) United States Patent
Pohlman et al.

(10) Patent No.: US 11,172,801 B2
(45) Date of Patent: Nov. 16, 2021

(54) FULL RECOVERY TANK SHUTOFF

(71) Applicant: TECHTRONIC CORDLESS GP, Anderson, SC (US)

(72) Inventors: Kevin Pohlman, Tega Cay, SC (US); Rafael Davila, Kannapolis, NC (US); Nicholas DeBlasio, Waxhaw, NC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/132,079

(22) Filed: Dec. 23, 2020

(65) Prior Publication Data

US 2021/0204780 A1 Jul. 8, 2021

Related U.S. Application Data

(60) Provisional application No. 62/957,625, filed on Jan. 6, 2020.

(51) Int. Cl.
*A47L 9/28* (2006.01)

(52) U.S. Cl.
CPC ..... *A47L 9/2821* (2013.01); *A47L 9/2842* (2013.01); *A47L 9/2884* (2013.01)

(58) Field of Classification Search
CPC ..... A47L 9/2821; A47L 9/2842; A47L 9/2884
See application file for complete search history.

(56) References Cited

U.S. PATENT DOCUMENTS 6,042,656 A 3/2000 Knutson
6,131,236 A 10/2000 Roth
6,457,205 B1 10/2002 Conrad
6,526,622 B2 3/2003 Conrad
6,545,443 B2 4/2003 Kushida
6,832,407 B2 12/2004 Salem et al.
(Continued)

FOREIGN PATENT DOCUMENTS

CN 105534423 B 5/2016
DE 102011015574 A1 10/2012
(Continued)

OTHER PUBLICATIONS

International Search Report and Written Opinion for Application No. PCT/US2020/066775 dated Mar. 17, 2021 (15 pages).

*Primary Examiner* — Dung Van Nguyen
(74) *Attorney, Agent, or Firm* — Michael Best & Friedrdich LLP

(57) ABSTRACT

A cleaning system comprising a vacuum source, a current sensor, a recovery tank having a shutoff float configured to float on a surface of fluid within the recovery tank, and a controller. The vacuum source is in fluid communication with a suction inlet via first and second air paths within the recovery tank. The shutoff float is further configured to block the first air path upon the fluid within the recovery tank reaching a desired level. The controller is configured to receive, from the current sensor, a signal indicative of the current drawn by the vacuum source. The controller is further configured to determine, based on the current drawn by the vacuum source crossing a threshold, the fluid within the recovery tank has reached the desired level and control an operating element of the cleaning system upon determining the fluid within the recovery tank has reached the desired level.

21 Claims, 11 Drawing Sheets

(56) References Cited

U.S. PATENT DOCUMENTS

| | | | | |
|---|---|---|---|---|
| 7,237,298 | B2 | 7/2007 | Reindle et al. | |
| RE40,250 | E | 4/2008 | Kushida | |
| 7,377,009 | B2 | 5/2008 | Lee et al. | |
| 7,599,758 | B2 | 10/2009 | Reindle et al. | |
| 7,797,792 | B2 | 9/2010 | Cipolla et al. | |
| 8,099,829 | B2 | 1/2012 | Grove et al. | |
| 8,223,029 | B2 | 7/2012 | Chung et al. | |
| 8,516,650 | B2 * | 8/2013 | Beers | A47L 9/2889 15/319 |
| 8,689,398 | B2 | 4/2014 | Chung et al. | |
| 9,039,844 | B2 | 5/2015 | Pears et al. | |
| 9,305,727 | B2 * | 4/2016 | Holsten | A47L 9/2868 |
| 9,693,667 | B2 | 7/2017 | Cunningham | |
| 9,717,390 | B2 | 8/2017 | Pears et al. | |
| 10,716,447 | B2 * | 7/2020 | Shrader | A47L 9/2884 |
| 10,959,583 | B2 * | 3/2021 | Valentini | B01D 45/16 |
| 2007/0283521 | A1 | 12/2007 | Foster | |
| 2011/0265284 | A1 | 11/2011 | Morgan | |
| 2014/0007369 | A1 | 1/2014 | Williams | |
| 2017/0127900 | A1 | 5/2017 | Wright | |
| 2017/0273533 | A1 | 9/2017 | Cunningham | |
| 2021/0093143 | A1 * | 4/2021 | Nguyen | A47L 11/292 |

FOREIGN PATENT DOCUMENTS

| | | | |
|---|---|---|---|
| EP | 3162262 | A2 | 5/2017 |
| EP | 3213665 | A1 | 9/2017 |
| GB | 2366189 | A | 3/2002 |

* cited by examiner

FULL RECOVERY TANK SHUTOFF

CROSS-REFERENCE TO RELATED APPLICATIONS

This application claims priority to U.S. Provisional Patent Application No. 62/957,625, filed Jan. 6, 2020, the entire contents of which are hereby incorporated by reference herein.

FIELD

Embodiments relate to tools, such as but not limited to, cleaning systems and/or cleaners.

SUMMARY

Tools, such as cleaners, may include vacuum sources and/or pumps which are powered by a rechargeable battery pack. Cleaners may further include a recovery tank configured to store fluid and/or debris drawn up from a surface being cleaned. Upon the recovery tank reaching a maximum storage capacity, the fluid stored within the recovery tank may back flow out of the recovery tank and on to the surface being cleaned. In addition, the vacuum source and/or pump of the cleaner may continue to draw power from the rechargeable battery pack despite the recovery tank being unable to store any more fluid and/or debris. This may cause the voltage of the rechargeable battery pack to decrease even though the cleaner is not capable of drawing up fluid and/or debris from the surface being cleaned.

One embodiment provides a cleaning system including a vacuum source and at least one operating component selected from the group consisting of the vacuum source, a power supply, a pump, a valve, an agitator motor, and an indicator. The cleaning system further includes a current sensor configured to sense a current provided to the vacuum source, a suction inlet in fluid communication with the vacuum source, and a recovery tank configured to store the fluid drawn through the suction inlet, via the vacuum source, from a surface to be cleaned. The recovery tank includes a first air path in fluid communication with the vacuum source and the suction inlet and a second air path in fluid communication with the vacuum source and the suction inlet. The recovery tank further includes a shutoff float configured to float on a surface of the fluid within the recovery tank. The shutoff float closes the first air path when the surface of the fluid within the recovery tank reaches a desired level. The cleaning system further includes a controller having an electronic processor. The controller is configured to receive, from the current sensor, a signal indicative of the current drawn by the vacuum source and determine, based on the current drawn by the vacuum source crossing a threshold, the fluid within the recovery tank has reached the desired level. The controller is further configured to control the operating component upon determining the fluid within the recovery tank has reached the desired level.

Another embodiment provides a method of operating a cleaning system having a vacuum source in fluid communication, via a first air path and a second air path of a recovery tank, with a suction inlet. The recovery tank is configured to store a fluid drawn through the suction inlet, by the vacuum source, from a surface to be cleaned. The recovery tank further includes a shutoff float configured to float on a surface of the fluid within the recovery tank. The method comprises closing off, via the shutoff float, the first air path when the surface of the fluid within the recovery tank reaches a desired level. The method further comprises sensing, via a current sensor, a current drawn the vacuum source and receiving, via a controller, a signal indicative of the current drawn by the vacuum source. The method further comprises determining, via the controller, when the fluid within the recovery tank has reached a desired level and controlling, via the controller, an operating component upon determining the fluid within the recovery tank has reached the desired level, wherein the operating component is selected from the group consisting of the vacuum source, a power supply, a pump, a valve, an agitator motor, and an indicator.

Yet another embodiment provides a cleaning system comprising a vacuum source and at least on operating component selected from the group consisting of the vacuum source, a power supply, a pump, a valve, an agitator motor, and an indicator. The cleaning system further comprises a current sensor configured to sense a current drawn by the vacuum source, a suction inlet in fluid communication with the vacuum source, and a recovery tank configured to store fluid drawn through the suction inlet from a surface by the vacuum source. The recovery tank includes an inlet duct having an inlet aperture and an outlet aperture, the outlet aperture facing downward towards a lower end of the recovery tank and spaced a predetermined distance from the lower end of the recovery tank corresponding to a desired level. The cleaning system also comprises a controller having an electronic processor that is configured to receive a signal indicative of the current drawn by the vacuum source, determine the fluid within the recovery tank has reached the desired level based on the current drawn by the vacuum source crossing a threshold, and control the vacuum source upon determining the fluid within the recovery tank has reached the desired level.

Yet another embodiment provides a cleaning system comprising a vacuum source and at least on operating component selected from the group consisting of a pump, a valve, and an agitator motor. The cleaning system further comprises a current sensor configured to sense a current drawn by the vacuum source, a suction inlet in fluid communication with the vacuum source, and a recovery tank configured to store fluid drawn through the suction inlet from a surface by the vacuum source. The recovery tank includes an air path in fluid communication with the vacuum source and the suction inlet. The recovery tank further includes a shutoff float configured to float on a surface of the fluid within the recovery tank. The shutoff float closes off the air path when the surface of the fluid within the recovery tank reaches a desired level. The cleaning system further includes a controller having an electronic processor. The controller is configured to receive, from the current sensor, a signal indicative of the current drawn by the vacuum source and determine, based on the current drawn by the vacuum source crossing a threshold, the fluid within the recovery tank has reached the desired level. The controller is further configured to control the operating component upon determining the fluid within the recovery tank has reached the desired level.

Other aspects of the application will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
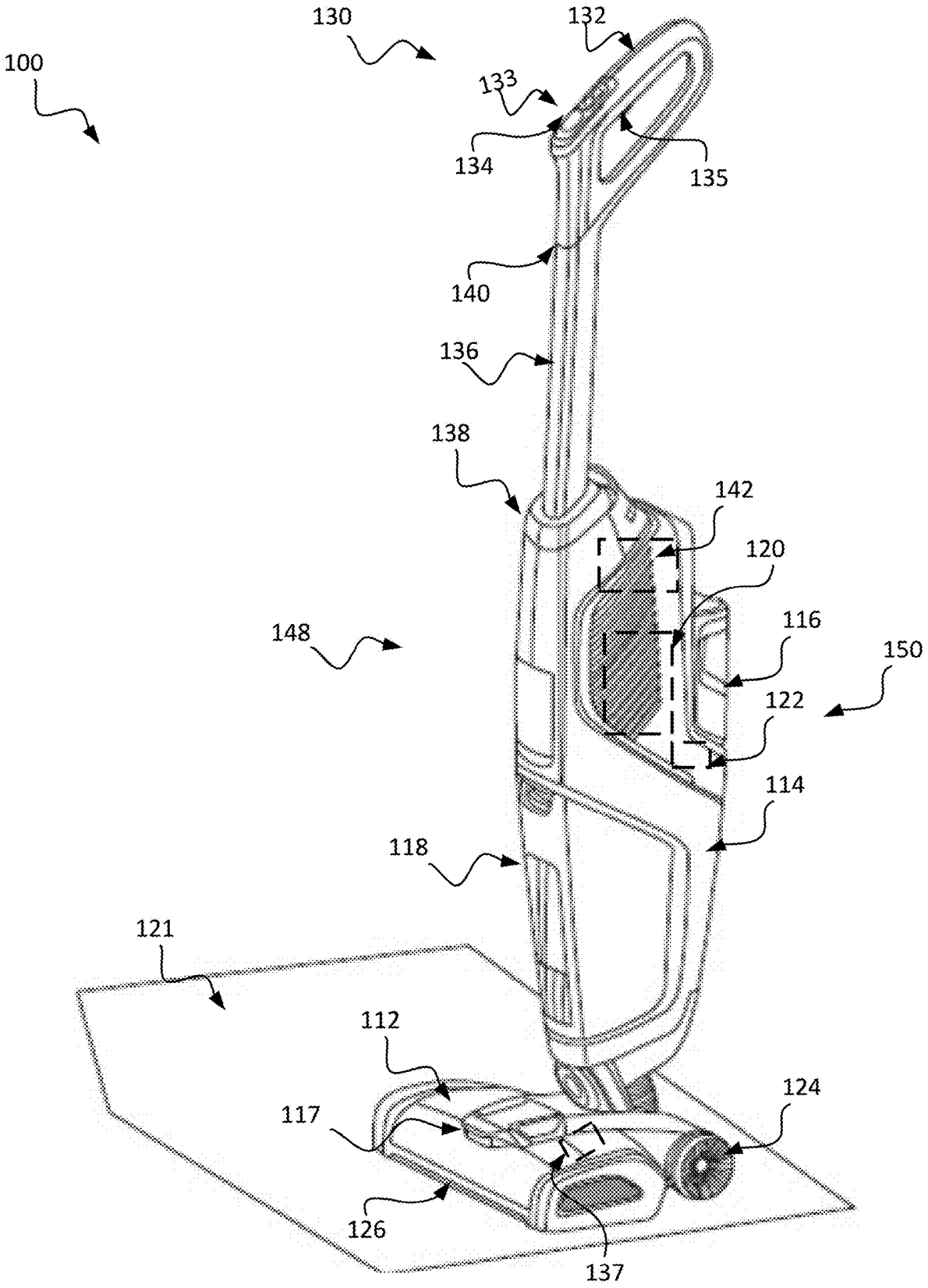
FIG. 1 is a perspective view of a cleaning system according to some embodiments.
Figure 2:
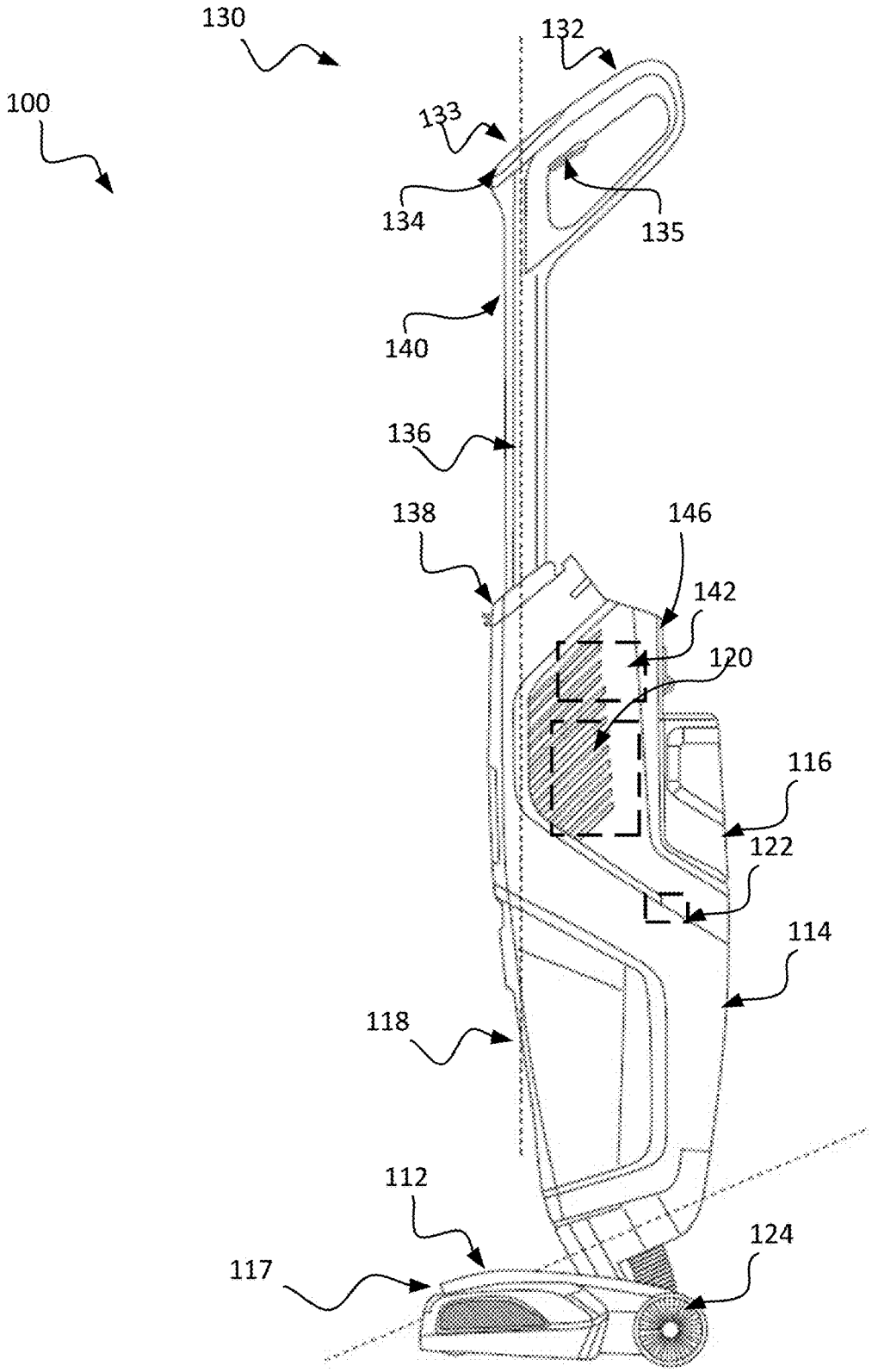
FIG. 2 is a side view of the cleaning system of FIG. 1 according to some embodiments.
Figure 3:
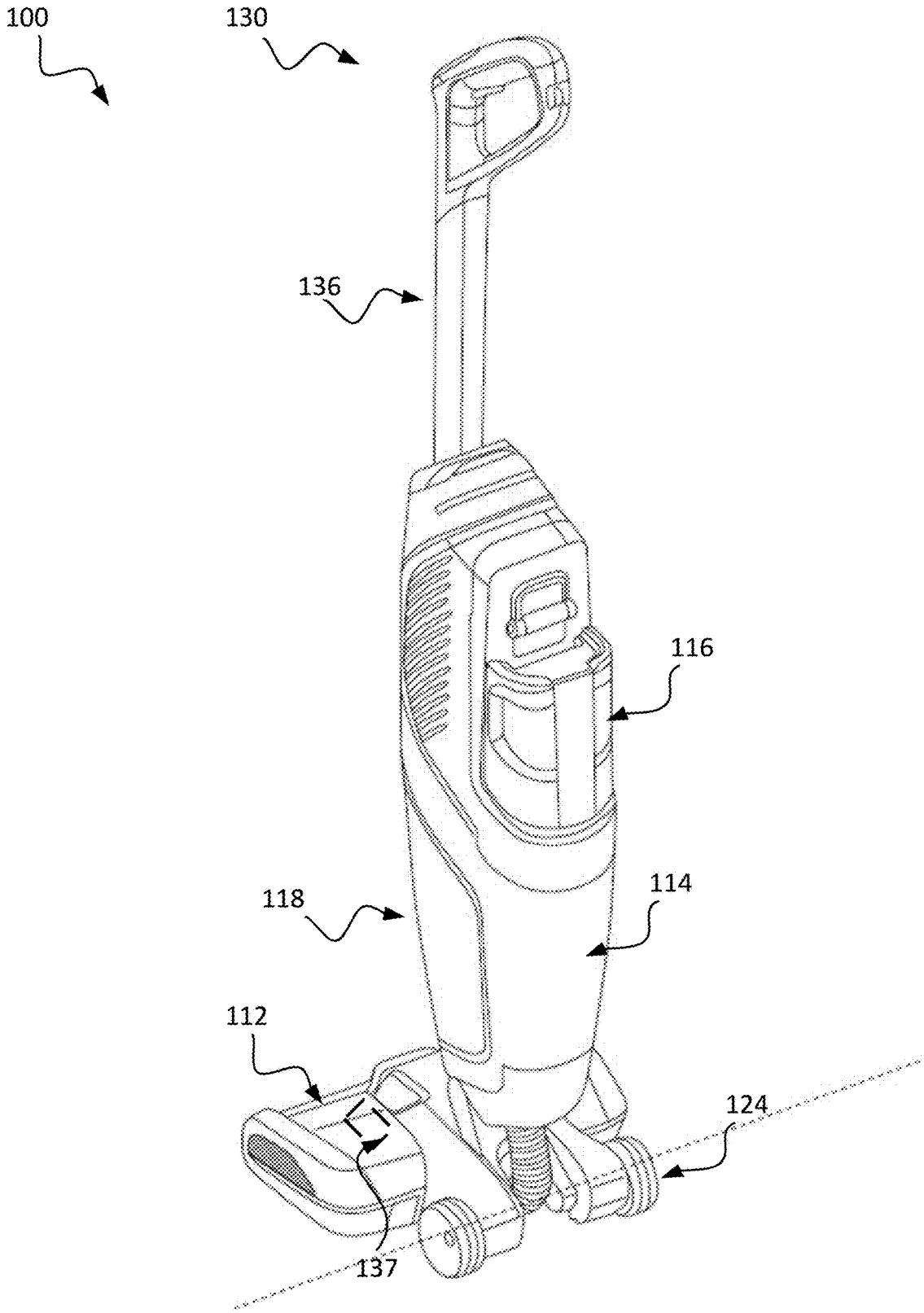
FIG. 3 is a rear view of the cleaning system of FIG. 1 according to some embodiments.

FIGS. 1-3 illustrate a cleaning system 100 according to some embodiments. The cleaning system 100 includes a base 112 and a body 114 pivotally coupled to the base 112. The body 114 may be pivotal relative the base 112 between the upright storage position (FIG. 1) and an inclined operating position. The cleaning system 100 may further include a supply tank 116, a distribution nozzle 117, a recovery tank 118, and a vacuum source 120. The supply tank 116 is configured to store a cleaning fluid, and the cleaning system 100 is operable to dispense the cleaning fluid onto a surface 121 to be cleaned through the distribution nozzle 117, such as by a pump and/or valve 122, or other fluid distribution system in communication with the distribution nozzle 117. The vacuum source 120 includes a motor and a fan. The motor and the fan are operable to draw the cleaning fluid from the surface 121 into the recovery tank 118. In some embodiments, the fluid distribution system is omitted and the cleaning system 100 is configured to recover fluids from the surface 121, such as a wet/dry vacuum.

The base 112 is movable over the surface 121 to be cleaned. In the illustrated embodiment, the base 112 includes wheels 124 to facilitate moving the base 112 over the surface 121 to be cleaned. The base 112 includes a suction inlet 126 in fluid communication with the vacuum source 120 and the recovery tank 118. The cleaning fluid is drawn from the surface 121 to be cleaned through the suction inlet 126 and into the recovery tank 118. The base 112 may further include the distribution nozzle 117 in fluid communication with the supply tank 116. The distribution nozzle 117 dispenses the cleaning fluid toward the surface 121 to be cleaned.

The cleaning system 100 may further include a handle assembly 130. The handle assembly 130 includes a grip 132 and a user-interface 133 adjacent the grip 132. The grip 132 is grabbed by the user to move the cleaning system 100 along the surface 121 and to pivot the body 114 relative to the base 112. In some embodiments, the user-interface 133 includes one or more indicators 134 to provide operating information to the user. In some embodiments, the user-interface 133 includes an actuator 135. The actuator 135 may be operable to control the flow of cleaning fluid from the supply tank 116 through the distribution nozzle 117. The handle assembly 130 may further include an extension 136 that extends from the body 114. The extension 136 includes a first end 138 and a second end 140. The first end 138 is coupled to and adjacent the body 114. The second end 140 may be adjacent the grip 132.

In some embodiments, the base 112 may further include a brushroll and/or other agitator adjacent the suction inlet 126. The brushroll and/or other agitator may be positioned and configured to contact the surface 121 being cleaned such that it may agitate, wipe, scrub, etc. the surface 121 being cleaned. The cleaning system 100 may further include an agitator motor 137 that rotates the brushroll and/or other agitator. The brushroll and/or other agitator may be operably connected to the agitator motor 137 by a transmission, which may include a belt, gears, or other transmission. In one embodiment, the brushroll and/or other agitator and suction inlet 126 cooperate to ingest air and debris from the surface 121 being cleaned. In some embodiments, the cleaning system 100 includes a single brushroll. In other embodiments, the cleaning system 100 may include additional brushrolls and/or agitators that are positioned in parallel to the brushroll and formed from the same or different materials.

In the illustrated embodiment, the cleaning system 100 further includes a rechargeable battery pack 142 that provides power to the vacuum source 120 and/or other components of the cleaning system 100. In some embodiments, the rechargeable battery pack 142 provides a constant voltage (for example, 12 volts) to the vacuum source 120. The rechargeable battery pack 142 may be stored in a battery receptacle (not shown), the battery receptacle having an opening through which the rechargeable battery pack 142 may be removed or replaced within the battery receptacle. A battery door 146 (FIG. 2) may be coupled to an edge of the opening of the battery receptacle, the battery door 146 being configured to cover and provide access to an interior of the battery receptacle. In other embodiments, the cleaning system receives power from an AC power source (for example, an AC power outlet).

In some embodiments, the rechargeable battery pack 142 is a rechargeable lithium-ion battery. The rechargeable battery pack 142 may include one or more battery cells. In some embodiments, the one or more battery cells are connected in a series-type configuration. However, in other embodiments, the one or more battery cells are connected in a different configuration, for example, a series-type and/or a parallel-type configuration.

Figure 4:
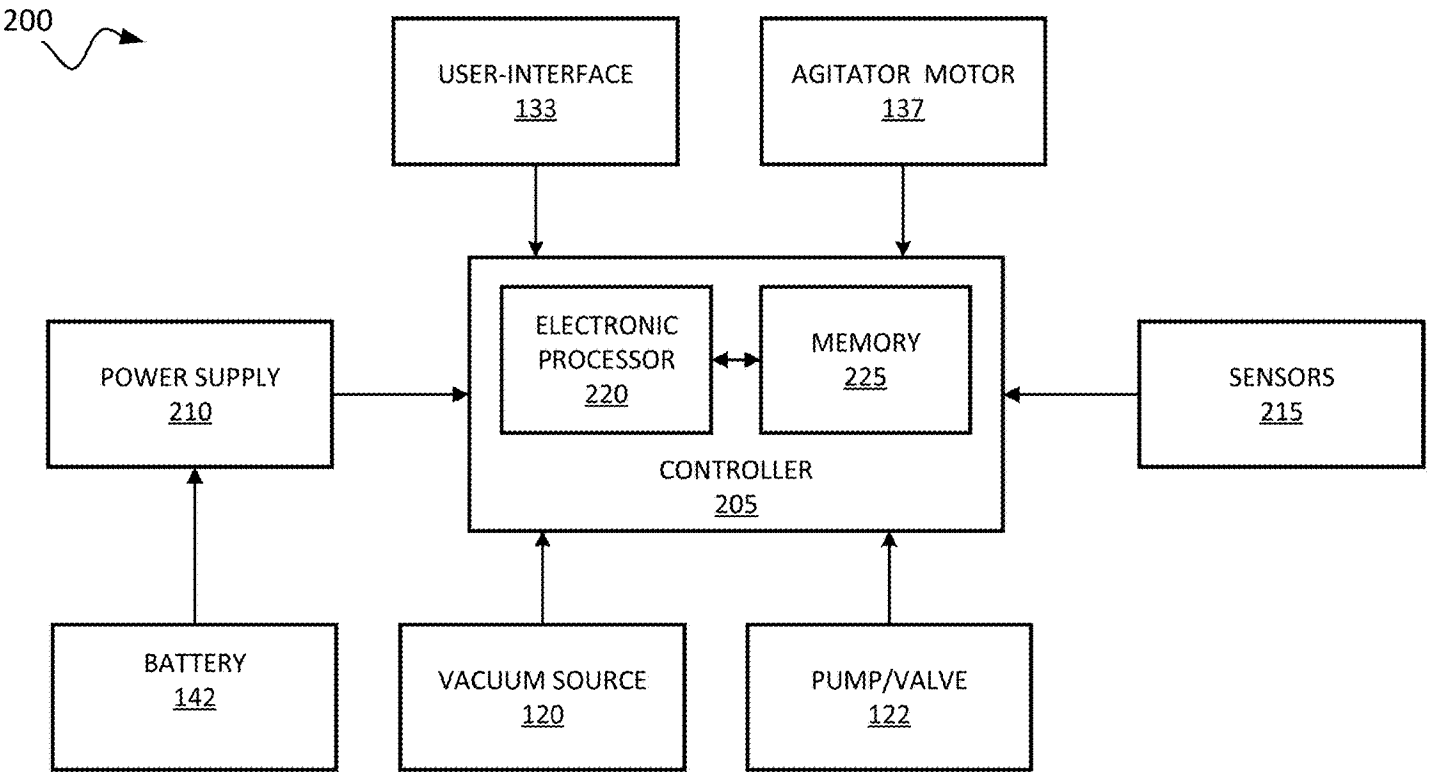
FIG. 4 is a block diagram of the control system of the cleaning system of FIG. 1 according to some embodiments.
Figure 5:
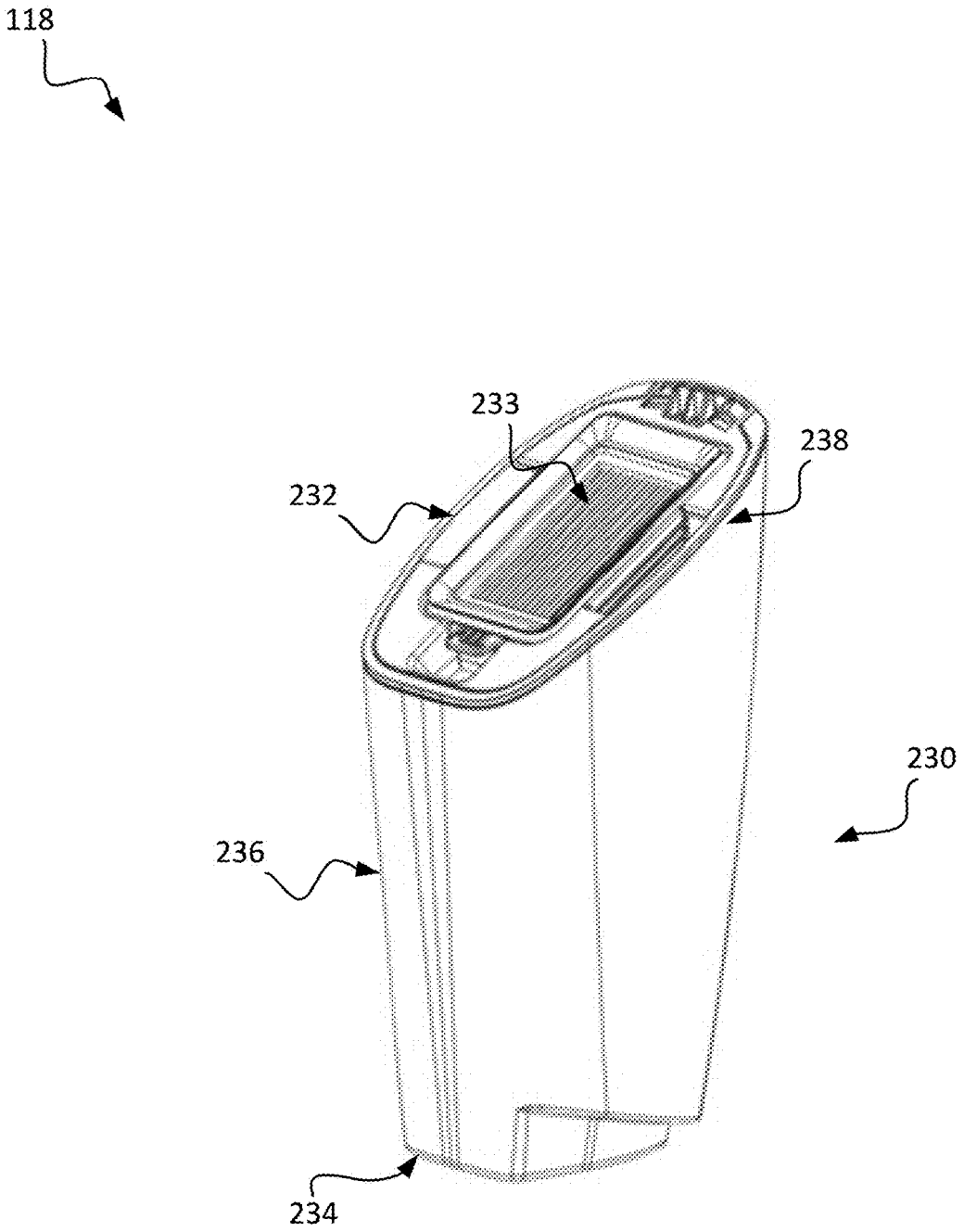
FIG. 5 is a first perspective view of a recovery tank of the cleaning system of FIG. 1 according to some embodiments.
Figure 6:
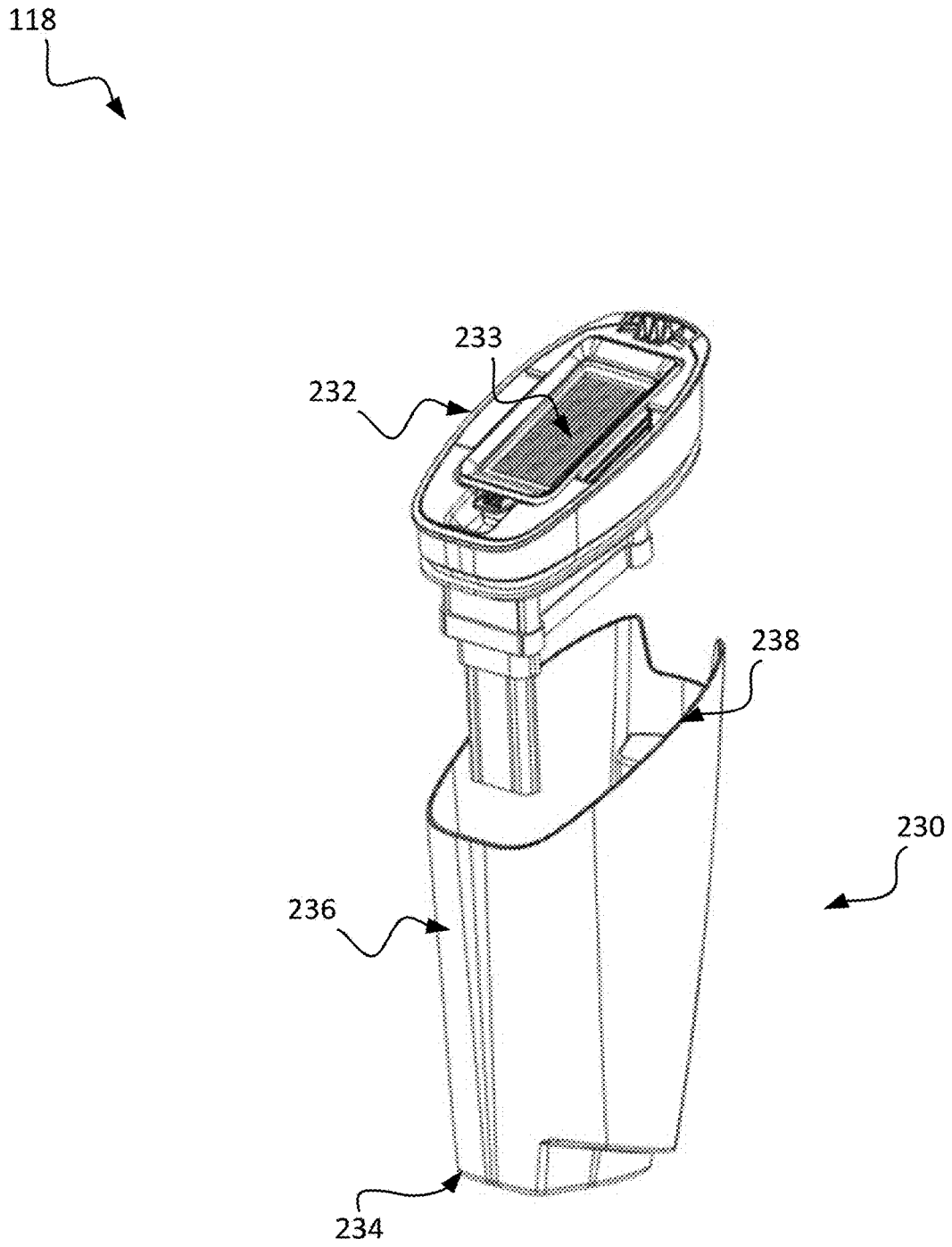
FIG. 6 is a second perspective view of the recovery tank of the cleaning system of FIG. 1 according to some embodiments.
Figure 7:
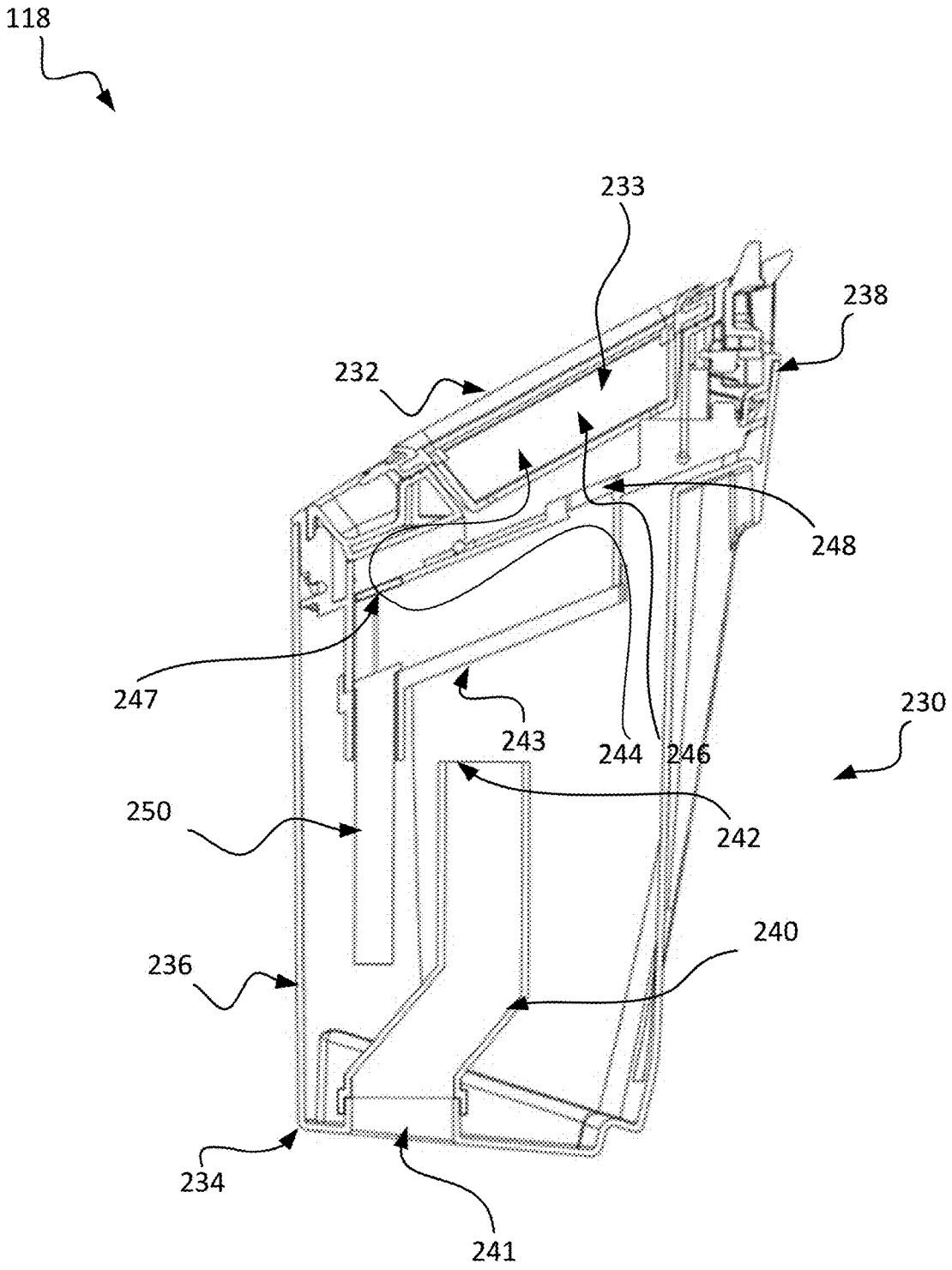
FIG. 7 is a first side view of the recovery tank of the cleaning system of FIG. 1 according to some embodiments.
Figure 8:
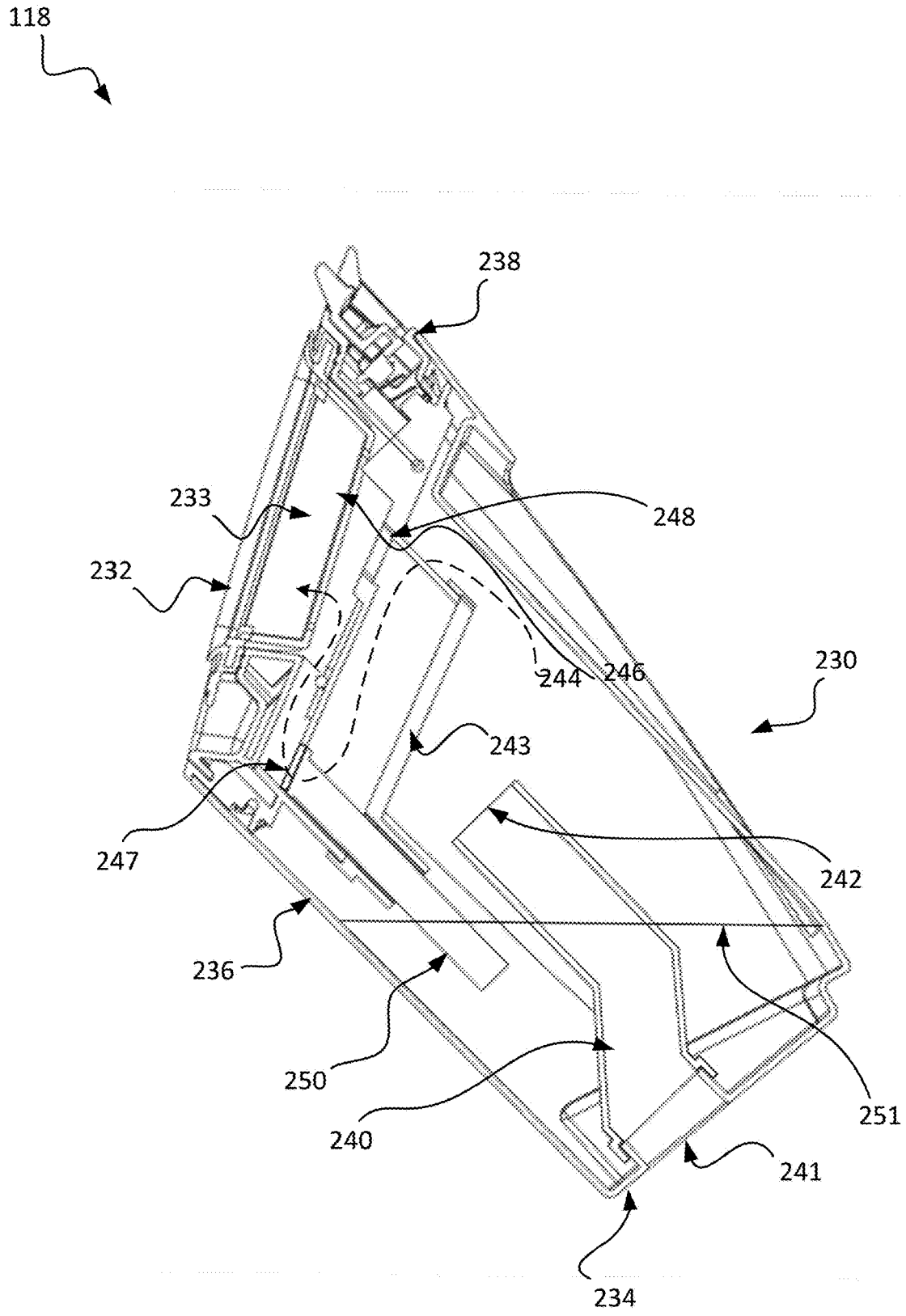
FIG. 8 is a second side view of the recovery tank of the cleaning system of FIG. 1 shown in an in-use orientation according to some embodiments.

FIG. 4 is a block diagram of a control system 200 of the cleaning system 100 according to some embodiments. The control system 200 includes the controller 205. The controller 205 is electrically and/or communicatively connected to a variety of modules or operating elements of the cleaning system 100. For example, the controller 205 is connected to the vacuum source 120, the pump and/or valve 122, the user-interface 133 (which includes indicator 134), the agitator motor 137, a power supply 210, and one or more sensors 215. In some embodiments, the one or more sensors 215 are current sensors that sense the current drawn by vacuum source 120. In some embodiments, the controller 205 is operable to control the one or more operating elements of the cleaning system 100, such as the vacuum source 120, the pump and/or valve 122, the user-interface 133, the agitator motor 137, and the power supply 210 based on determined characteristics of the cleaning system 100.

In some embodiments, the controller 205 includes a plurality of electrical and electronic components that provide power, operational control, and protection to the components and modules within the controller 205 and/or the cleaning system 100. For example, the controller 205 includes, among other things, an electronic processor 220 (for example, a microprocessor or another suitable programmable device) and a memory 225.

The memory 225 includes, for example, a program storage area and a data storage area. The program storage area and the data storage area can include combinations of different types of memory, such as read-only memory (ROM) and random access memory (RAM). Various non-transitory computer readable media, for example, magnetic, optical, physical, or electronic memory may be used. The electronic processor 220 is communicatively coupled to the memory 225 and executes software instructions that are stored in the memory 225, or stored in another non-transitory computer readable medium such as another memory or a disc. The software may include one or more applications, program data, filters, rules, one or more program modules, and other executable instructions.

Power supply 210 is configured to supply power to the controller 205 and/or other components of the cleaning system 100. As illustrated, in some embodiments, the power supply 210 receives power from the rechargeable battery pack 142 and provides regulated power to the controller 205 and/or other components of the cleaning system 100. In other embodiments, the power supply 210 may receive power from an AC power source (for example, an AC power outlet).

The user-interface 133 is configured to receive input from a user and/or output information to the user concerning the cleaning system 100. Although illustrated as including indicator 134 and actuator 135, in other embodiments, the user-interface 133 may further include, in addition to or in lieu of indicator 134 and actuator 135, a display (for example, a primary display, a secondary display, etc.) and/or input devices (for example, touch-screen displays, a plurality of knobs, dials, switches, buttons, etc.).

Referring to FIGS. 5-8, the recovery tank 118 includes a tank body 230 and a cover 232 attached to the tank body 230. The cover 232 includes a filter 233 forming a recovery tank air outlet. The tank body 230 has a lower end wall 234 and a sidewall 236 that extends upwardly from the lower end wall 234 to an upper end 238 of the tank body 230. The lower end wall 234 supports an inlet duct 240. The inlet duct 240 extends vertically upwards from the lower end wall 234 and includes an inlet aperture 241 and an outlet aperture 242. The inlet aperture 241 is in fluid communication with the suction inlet 126 (FIG. 1), and the outlet aperture 242 opens facing upwards towards the upper end 238 of the tank body 230. Air and fluid enter the recovery tank 118 through the inlet aperture 241 of the inlet duct 240 and travel upwards through the outlet aperture 242. In the embodiment illustrated in FIGS. 5-8, the air and fluid traveling through the outlet aperture 242 are directed to a baffle surface 243 to separate fluid from the air flow such that fluid accumulates in the recovery tank body 230. Air suctioned by the vacuum source 120 exits the recovery tank 118 by flowing through a first air path 244 and/or a second air path 246, both of which direct the air to exit through one or both of a first suction air outlet 247 and a second suction air outlet 248 in the cover 232. The first suction air outlet 247 and the second suction air outlet 248 are in fluid communication with the filter 233 and recovery tank air outlet.

The recovery tank 118 further includes a shutoff float 250. In operation, the shutoff float 250 moves between a lowermost position (illustrated in FIG. 7) and an uppermost position (illustrated in FIG. 8). Gravity maintains the shutoff float 250 in the lowermost position when the fluid level within the recovery tank is below a minimum fluid level. When the shutoff float 250 is in/or near the lowermost position, air exiting the recovery tank 118 can flow through the first air path 244 through the first suction air outlet 247 and through the second air path 246 through the second suction air outlet 248 without obstruction. In addition, when the shutoff float 250 is in/or near the lowermost position, the load on the vacuum source 120 is at a normal operating condition and the current drawn by the vacuum source 120 is at a normal operation load (for example, 7 amps). As fluid enters the recovery tank 118 through the inlet aperture 241 of inlet duct 240, the fluid level within the recovery tank 118 rises, causing the buoyant shutoff float 250 to raise towards the uppermost position. As illustrated by the in-use orientation of the recovery tank 118 shown in FIG. 8, the shutoff float 250 is configured to be in the uppermost position when the fluid level in the recovery tank reaches a predetermined desired maximum fluid level 251. When the shutoff float 250 is in the uppermost position, the shutoff float 250 obstructs and closes off the first suction air outlet 247, obstructing the first air path 244. Accordingly, when the first air path 244 is blocked, the load on the vacuum source 120 decreases because airflow through the system is restricted, and the current drawn by the vacuum source 120 decreases.

Completely closing the first air path 244 forces all of the air flow through the recovery tank 118 to exit the recovery tank 118 through the second air path 246 through the second suction air outlet 248 before exiting the recovery tank 118. Furthermore, closing the first suction air outlet 247 and blocking the first air path 244 causes the load on the vacuum source 120 to decrease because the volume flow rate of air exiting is reduced. Thus, the current drawn by the vacuum source 120 decreases and drops below a predetermined minimum current threshold value (for example, 5 amps). Therefore, when the fluid in the recovery tank 118 reaches the desired maximum fluid level 251, the current drawn by the vacuum source 120 drops and remains below the predetermined minimum current threshold.

The combined outlet area of the first suction air outlet 247 and the second suction air outlet 248 provide a normal operating volume flow rate through the cleaning system 100. The area of the first suction air outlet 247 may be selected to be a portion of the combined outlet area sufficient to cause a measurable decrease in the current drawn by the vacuum source 120 when blocked by the shutoff float 250, for example 30% of the combined outlet area. In some embodiments, the area of the first suction air outlet 247 is selected between 10% and 80%, and more particularly between 20% and 60% of the combined outlet area of the first suction air outlet 247 and the second suction air outlet 248. Providing a divided outlet area where the shutoff float 250 closes only a portion of the outlet area enables the cleaning system 100 to have a smaller shutoff float 250. Additionally, by dividing the outlet area, the shutoff float 250 is exposed to a portion of the suction airflow, and the area of the first suction air outlet 247 may be selected such that the suction airflow passing through the first suction air outlet 247 is not or is less able to hold the shutoff float 250 in the absence of fluid buoyancy, thereby reducing inadvertent shut-offs due to being lifted by waves or splashing of fluid in the recovery tank 118 or other movement.

The shutoff float 250 is configured to close the first suction air outlet 247 thereby blocking the first air path 244 when buoyed by the desired maximum fluid level 251 in the recovery tank 118. When fluid in the recovery tank 118 has reached the desired maximum fluid level 251 and the first air path 244 blocked by the shutoff float, the vacuum source remains in fluid communication with the inlet aperture 241 through the second suction air outlet 248 via the second air path 246; however, due to the reduced volume flow rate, the increased cleaning system 100 pressure may be too high (low suction) to draw any more fluid into the recovery tank 118 via the inlet aperture 241. In some embodiments, the desired maximum fluid level 251 in the recovery tank 118 is selected to be at a level before the fluid level in the recovery tank 118 exceeds the height of inlet duct 240. Therefore, the fluid in the recovery tank 118 fluid will be below the outlet aperture 242 of inlet duct 240 and unable to back flow out of the recovery tank 118 and through the inlet duct 240 on to the surface 121 to be cleaned.

In operation, the controller 205 monitors the current drawn by the vacuum source 120 (for example, via current sensor 215). The current sensor signal may be filtered or otherwise smoothed. In some embodiments, the shutoff float 250 closing the first suction air outlet 247 causes a step change in the current sensor signal. The predetermined minimum current threshold may be selected corresponding to the selected area of the first suction air outlet 247 and the vacuum source 120, such that normal variation in the current drawn by the vacuum source 120 while the first air path 244 and the second air path 246 are open will not cross the predetermined minimum current threshold; however, blocking the first air path 244 will cross the predetermined minimum current threshold.

The controller 205 determines that fluid in the recovery tank 118 reaches the desired maximum fluid level 251 when the current drawn by the vacuum source drops below the predetermined minimum current threshold. In some embodiments, the controller repeatedly samples the current drawn by the vacuum source 120. For example, the controller 205 may sample the current drawn by the vacuum source 120 every millisecond. In other embodiments, the controller 205 may sample the current drawn by the vacuum source 120 every half second.

In some embodiments, the controller determines that fluid in the recovery tank 118 has reached the desired maximum fluid level 251 after the current drawn by the vacuum source 120 drops below the minimum current threshold for a predetermined period of time (for example, 2 seconds). Requiring the current drawn by the vacuum source 120 to remain below the minimum current threshold for a predetermined period of time prevents any momentary drops in current, such as by the shutoff float 250 being lifted by waves or splashing of fluid in the recovery tank 118 or other movement, drawn by the vacuum source 120 from errantly signaling to the controller 205 that the desired maximum fluid level 251 within the recovery tank 118 has been reached.

In some embodiments, when the controller 205 determines that the desired maximum fluid level 251 within the recovery tank 118 has been reached, the controller 205 may control the operation of the vacuum source 120 and/or other operating elements of the cleaning system 100. In some embodiments, the controller 205 reduces power provided to the vacuum source 120 and/or other operating elements of the cleaning system 100 by the power supply 210 when the desired maximum fluid level 251 within the recovery tank 118 has been reached. In other embodiments, the controller 205 prohibits power provided by the power supply 210 to the vacuum source 120 and/or other operating elements of the cleaning system 100 when the desired maximum fluid level 251 within the recovery tank 118 has been reached. In some embodiments, the cleaning system 100 is no longer operational when the recovery tank 118 is full. The controller 205 may control the power supply 210, such as the battery pack 142, to conserve power when the cleaning system 100 is not operational by controlling the operation of the vacuum source 120 or turning off the cleaning system 100 when the recovery tank 118 is full. In some embodiments, the controller 205 may turn off the power supply 210 upon determining that the desired maximum fluid level 251 within the recovery tank 118 has been reached.

In some embodiments, the controller 205 controls the pump and/or valve 122 or other distribution system upon determining the fluid within the recovery tank 118 has reached the desired maximum fluid level 251 by prohibiting power provided by the power supply 210 to the pump 122 or closing the valve 122 to limit or stop distribution of fluid. Prohibiting power to the pump 122 prevents the pump 122 from drawing cleaning fluid out of the supply tank 116. Similarly, closing the valve 122 in the fluid distribution line prevents limits or prevents fluid from passing through the distribution nozzle 117. In other embodiments, the controller 205 may be further configured to control the agitator motor 137 upon determining the fluid within the recovery tank 118 has reached the desired maximum fluid level 251 by reducing or prohibiting power provided by the power supply 210 to the agitator motor 137.

In some embodiments, the controller 205 controls the user-interface 133 upon determining the fluid within the recovery tank 118 has reached the desired maximum fluid level 251. In particular, the controller 205 may be configured to activate the indicator(s) 134 of user-interface 133 upon determining the fluid within the recovery tank 118 has reached the desired maximum fluid level 251. For example, the controller 205 may activate the indicator(s) 134 by illuminating the indicator(s) 134 in a constantly lit state or pulsing the indicator(s) 134.

Figure 9:
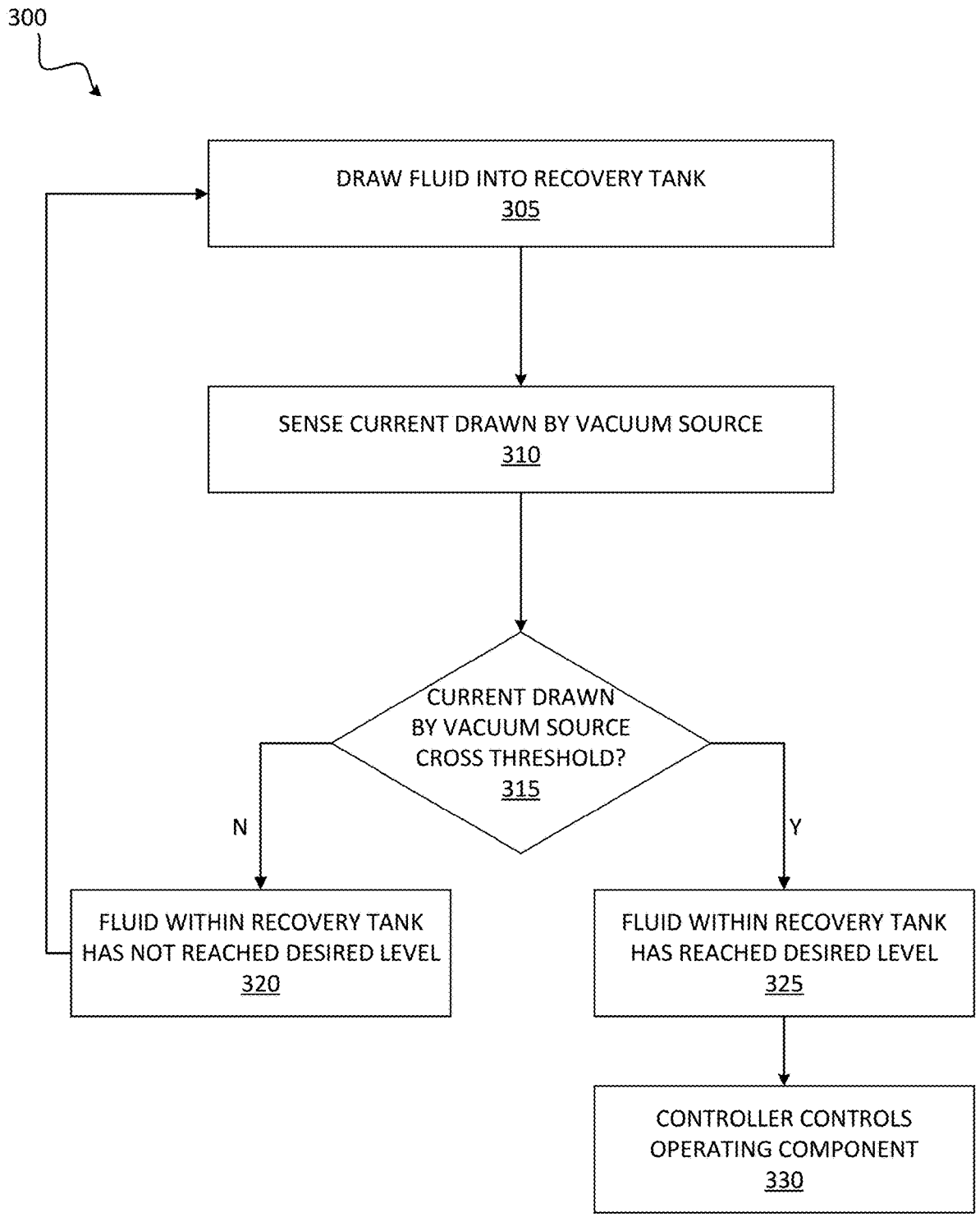
FIG. 9 is a flowchart illustrating the process or operation of the cleaning system of FIG. 1 according to some embodiments.

FIG. 9 is a flowchart illustrating a process, or operation, 300 for operating the cleaning system 100. It should be understood that additional steps may be added and not all of the steps may be required. The cleaning system 100 draws fluid into the recovery tank 118 via suction inlet 126 (block 305). The current sensor 215 senses a current drawn by the vacuum source 120 (block 310). The controller 205 receives a signal indicative of the current drawn by the vacuum source 120 from the current sensor 215 and determines whether the current drawn by the vacuum source 120 has crossed a threshold (block 315). If the current drawn by the vacuum source 120 has not crossed the threshold, the fluid within the tank has not reached the desired level (block 320). If the current drawn by the vacuum source 120 has crossed the threshold, the shutoff float 250 has closed off the first air path 244 of recovery tank 118 and the fluid level within the recovery tank 118 has reached a desired level (block 325). Accordingly, the controller 205 controls one or more operating components of the cleaning system 100 (block 330).

In some alternative embodiments (not shown) of the cleaning system 100, the recovery tank 118 may include a single air path. In such embodiments, the cleaning system includes a vacuum source and at least one operating component selected from the group consisting of a pump, a valve, and an agitator motor. The cleaning system further includes a current sensor configured to sense a current drawn by the vacuum source, a suction inlet in fluid communication with the vacuum source, and a recovery tank configured to store the fluid drawn through the suction inlet from a surface to be cleaned. The recovery tank includes an air path in fluid communication with the vacuum source and the suction inlet. The recovery tank further includes a shutoff float configured to float on the surface of the fluid within the recovery tank. The shutoff float closes the air path when the surface of the fluid within the recovery tank reaches a desired level. The cleaning system further includes a controller having an electronic processor. The controller is configured to receive, from the current sensor, a signal indicative of the current drawn by the vacuum source and determine the fluid within the recovery tank has reached the desired level based on current drawn by the vacuum source crossing a threshold. The controller is further configured to control the operating element upon determining the fluid within the recovery tank has reached the desired level. It should be understood that the controller may control the operating elements upon determining the fluid within the recovery tank has reached the desired level in a similar manner as described with respect to the illustrated embodiment of cleaning system 100.

Figure 10:
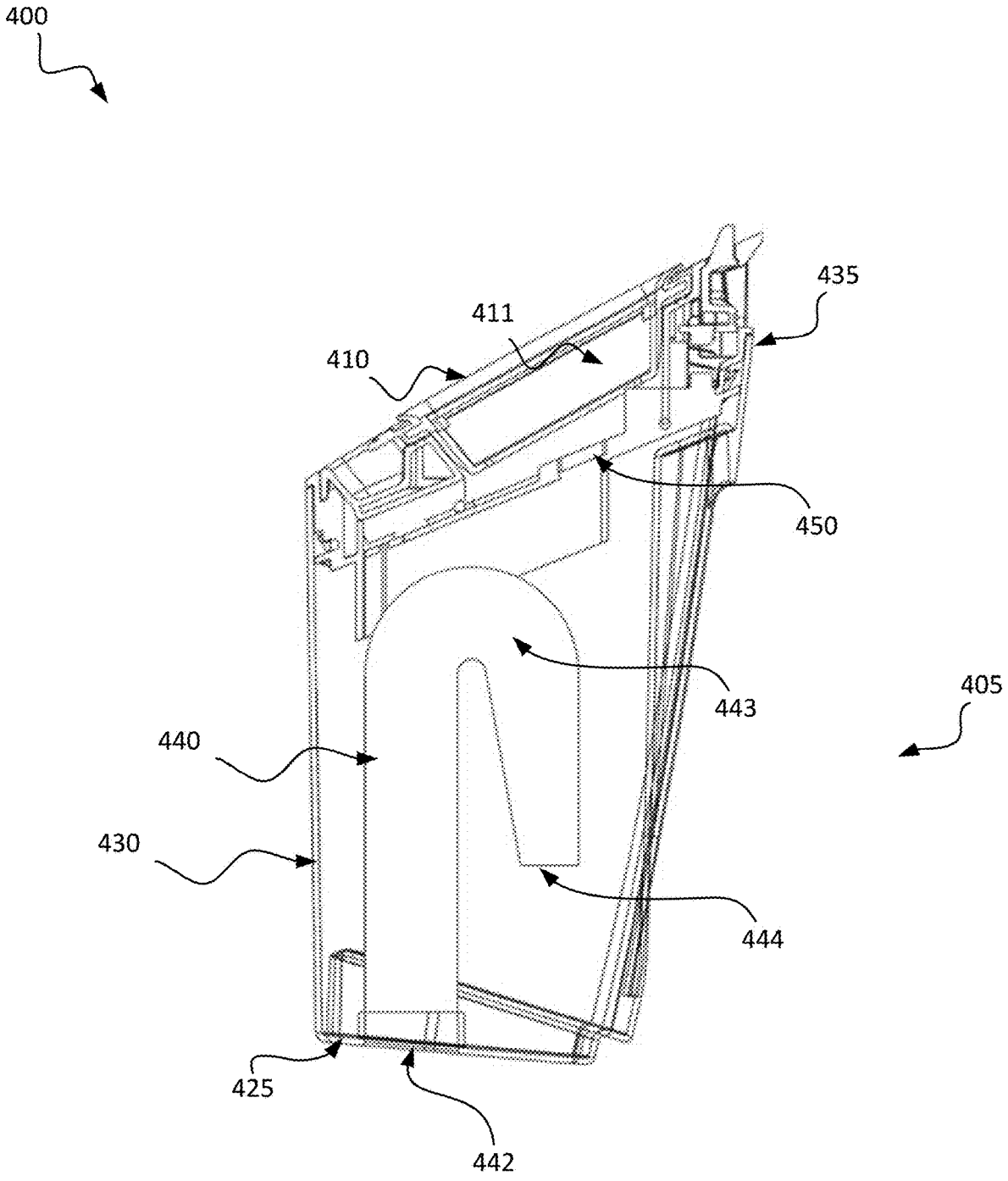
FIG. 10 is a side view of an alternative embodiment of the recovery tank of the cleaning system of FIG. 1.
Figure 11:
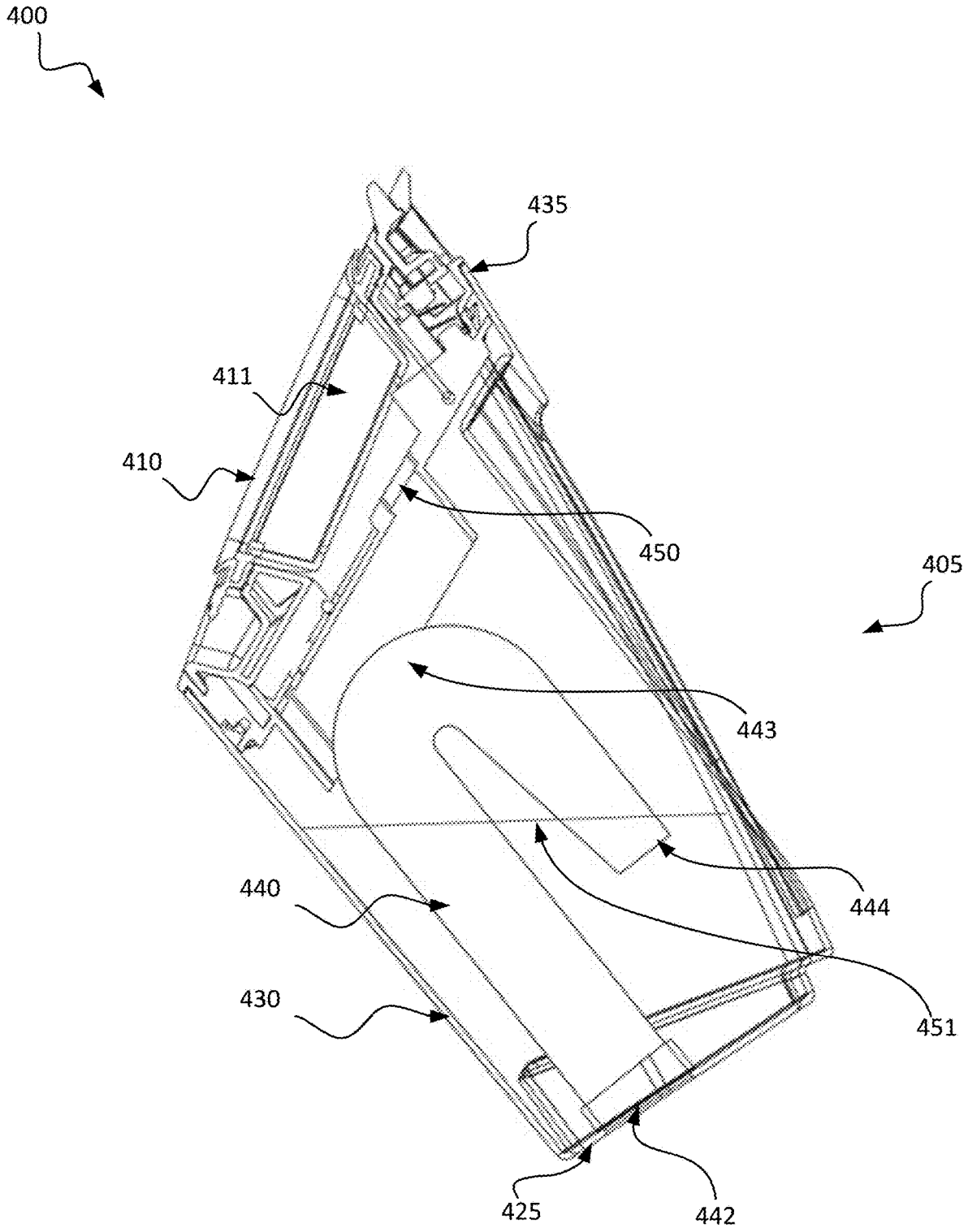
FIG. 11 is a second side view of the recovery tank of FIG. 10 shown in an in-use orientation according to some embodiments.

Referring to FIGS. 10 and 11, an alternative embodiment of a recovery tank 400 is illustrated. The recovery tank 400 includes a tank body 405 and a cover 410 attached to the tank body 405. The cover 410 may include a filter 411 forming a recovery tank air outlet. The tank body 405 has a lower end wall 425 and a sidewall 430 that extends upwardly from the lower end wall 425 to an upper end 435 of the tank body 405. The lower end wall 425 supports an inlet duct 440. The inlet duct 440 extends vertically upwards from the lower end wall 425 and includes an inlet aperture 442, a bend 443, and outlet aperture 444. The inlet aperture 442 is in fluid communication with the suction inlet 426. The outlet aperture 444 of the inlet duct 440 opens facing downward towards the lower end wall 425 of the recovery tank 400. Thus, the vacuum source 120 is in fluid communication with the suction inlet 126 via the inlet duct 440.

As illustrated by the in-use orientation of the recovery tank 400 shown in FIG. 11, the outlet aperture 444 may be spaced at a predetermined distance from the lower end wall 425 of the recovery tank 400 corresponding to a desired maximum fluid level 451, selected such that the outlet aperture 444 is submerged when the fluid level in the tank during operation of the cleaning system 100 reaches the desired maximum fluid level 451. In other embodiments (not shown), the inlet aperture may be provided in or near the upper end of the recovery tank body. In such embodiments, the inlet duct may extend from the inlet aperture in the upper end of the tank body with an outlet aperture facing downward towards the lower end of the recovery tank.

The outlet aperture 444 of the illustrated recovery tank 400 embodiment is configured to reduce the vertical height of the outlet aperture 444 in the in-use orientation. In some embodiments, the outlet aperture 444 is narrowed and/or angled relative to the fluid surface such that the outlet aperture 444 is blocked at a desired rate as the tank fluid level increases across the outlet aperture 444. In some embodiments, the outlet aperture 444 is angled toward the surface of the fluid such that approximately all of the outlet aperture 444 is blocked at the same time when the tank fluid level reaches the outlet aperture 444. Although the inlet duct 440 illustrated in FIGS. 10 and 11 is approximately J-shaped, other embodiments of the recovery tank (not shown) may include inlet ducts having varying shapes.

The vacuum source 120 draws air and fluid into the recovery tank 400 through inlet aperture 442 of the inlet duct 440. The suctioned air and fluid flow through the inlet duct 440 and out of the outlet aperture 444 of the inlet duct 440. The suctioned air exits the recovery tank 400 via a suction air outlet 450 in the cover 410 and the suctioned fluid falls towards the lower end wall 425 of the recovery tank 400. The fluid level within the recovery tank 400 rises during operation of the cleaning system 100. The fluid level reaches the desired maximum fluid level 451 when the outlet aperture 444 is submerged in the fluid.

During operation of the cleaning system 100, when the fluid level in the recovery tank 400 is below the outlet aperture 444 of the inlet duct, the load on the vacuum source is at a normal operating condition and the current drawn by the vacuum source is at a normal operating load (for example, 7 amps). As the fluid submerges the outlet aperture 444 of the inlet duct 440, the fluid level blocks the outlet aperture 444 thereby blocking the air flow to the vacuum source 120, and the current drawn by the vacuum source 120 decreases below a predetermined minimum current threshold (for example, 2 amps). The controller determines that fluid within the recovery tank 400 has reached the desired level when the current drawn by vacuum source 120 drops below the predetermined minimum current threshold. The predetermined minimum current threshold may be selected such that normal variation in the current drawn by the vacuum source 120 while the outlet aperture 444 is not blocked by fluid will not typically cross the predetermined minimum current threshold, but submerging the outlet aperture 444 in fluid will cross the predetermined minimum current threshold.

In some embodiments, when the controller 205 determines that the desired maximum fluid level 451 within the recovery tank 400 has been reached, the controller 205 may control the operation of the vacuum source 120 and/or other operating elements of the cleaning system 100. In some embodiments, the controller 205 reduces power provided to the vacuum source 120 and/or other operating elements of the cleaning system 100 by the power supply 210 when the desired maximum fluid level 451 within the recovery tank 400 has been reached. In other embodiments, the controller 205 prohibits power provided by the power supply 210 to the vacuum source 120 and/or other operating elements of the cleaning system 100 when the desired maximum fluid level 451 within the recovery tank 400 has been reached. In some embodiments, the cleaning system 100 is no longer operational when the recovery tank 400 is full. The controller 205 may control the power supply 210, such as the battery pack 142, to conserve power when the cleaning system 100 is not operational by controlling the operation of the vacuum source 120 or turning off the cleaning system 100 when the recovery tank 400 is full. In some embodiments, the controller 205 may turn off the power supply 210 upon determining that the desired maximum fluid level 251 within the recovery tank 118 has been reached.

When the outlet aperture 444 is submerged and air flow to the vacuum source 120 is blocked, the cleaning system 100 pressure may be too high (low suction) to draw any more fluid into the recovery tank 400, thereby rendering the cleaning system 100 nonoperational. Thus, controlling the vacuum source 120 when the outlet aperture 444 is submerged by fluid in the recovery tank 400 provides control of the cleaning system 100 without having a shutoff float in the recovery tank 400. Additionally, reducing or prohibiting power provided to the vacuum source 120 when the outlet aperture 444 is submerged by the fluid in the recovery tank 400 prevents the vacuum source 120 from increasing in temperature, and conserves energy. As illustrated in FIG. 10, the bend 443 in the J-shaped inlet duct 440 is disposed at a higher elevation within recovery tank 400 than the outlet aperture 444 with respect to the lower end wall 425. Therefore, fluid in the tank is unable to overcome the bend 443 and back flow out of the recovery tank 400 through the J-shaped inlet duct 440 when the outlet aperture 444 of the J-shaped inlet duct 440 is submerged.

In some embodiments, the controller 205 controls the pump and/or valve 122 or other distribution system upon determining the fluid within the recovery tank 400 has reached the desired maximum fluid level 451 by prohibiting power provided by the power supply 210 to the pump 122 or closing the valve 122 to limit or stop distribution of fluid. Prohibiting power to the pump 122 prevents the pump 122 from drawing cleaning fluid out of the supply tank 116. Similarly, closing the valve 122 in the fluid distribution line prevents limits or prevents fluid from passing through the distribution nozzle 117. In other embodiments, the controller 205 may be further configured to control the agitator motor 137 upon determining the fluid within the recovery tank 400 has reached the desired maximum fluid level 451 by reducing power provided by the power supply 210 or prohibiting power to the agitator motor 137.

In some embodiments, the controller 205 controls the user-interface 133 upon determining the fluid within the recovery tank 400 has reached the desired maximum fluid level 451. In particular, the controller 205 may be configured to activate the indicator(s) 134 of user-interface 133 upon determining the fluid within the recovery tank 400 has reached the desired maximum fluid level 451. For example, the controller 205 may activate the indicator(s) 134 by illuminating the indicator(s) 134 in a constantly lit state or pulsing the indicator(s) 134.

In some embodiments, the current drawn by the vacuum source 120 drops below a first current threshold just as the outlet aperture 444 of the inlet duct is partially submerged by the fluid in recovery tank 400. The current drawn by the vacuum source 120 drops below a second current threshold when the outlet aperture 444 of the inlet duct is fully submerged. In one such embodiment, the controller 205 reduces power provided to the vacuum source 120 when the current drawn by the vacuum source 120 drops below the first current threshold. In some embodiments, the controller 205 activates the indicator 134 to the user when the current drawn by the vacuum source 120 drops below the first current threshold. When the current drawn by the vacuum source 120 drops below the second current threshold, the controller 205 prohibits power from being provided to the vacuum source 120, and optionally controls the fluid distribution system including the pump and valve 122.

What is claimed is:

1. A cleaning system comprising:

a vacuum source;

at least one operating component selected from the group consisting of the vacuum source, a power supply, a pump, a valve, an agitator motor, and an indicator;

a current sensor configured to sense a current drawn by the vacuum source;

a suction inlet in fluid communication with the vacuum source;

a recovery tank configured to store fluid drawn through the suction inlet from a surface to be cleaned by the vacuum source, the recovery tank including a first air path in fluid communication with the vacuum source and the suction inlet;

a second air path in fluid communication with the vacuum source and the suction inlet; and a shutoff float configured to float on a surface of the fluid within the recovery tank and close off the first air path when a surface of the fluid within the recovery tank reaches a desired level; and a controller having an electronic processor, the controller configured to receive, from the current sensor, a signal indicative of the current drawn by the vacuum source;

determine, based on the current drawn by the vacuum source crossing a threshold, when the fluid within the recovery tank has reached the desired level; and control the operating component upon determining the fluid within the recovery tank has reached the desired level.

2. The cleaning system of claim 1, wherein the operating component is the vacuum source and the controller controls the vacuum source upon determining the fluid within the recovery tank has reached the desired level by reducing or prohibiting power to the vacuum source.

3. The cleaning system of claim 1, wherein the operating component is the power supply and the controller controls the power supply upon determining the fluid within the recovery tank has reached the desired level by turning off the cleaning system.

4. The cleaning system of claim 1, wherein closing the first air path reduces current drawn by the vacuum source.

5. The cleaning system of claim 1, wherein the controller controls the operating component upon determining the current drawn by the motor has dropped below a predetermined current threshold for a predetermined period of time.

6. The cleaning system of claim 1, wherein the vacuum source remains in fluid communication with the suction inlet via the second air path when the surface of the fluid reaches the desired level.

7. The cleaning system of claim 1, wherein the power supply is a battery configured to provide power to the vacuum source.

8. The cleaning system of claim 7, wherein the battery provides a constant voltage to the vacuum source.

9. The cleaning system of claim 1, wherein the operating component is the indicator and the controller activates the indicator upon determining the fluid within the recovery tank has reached the desired level.

10. The cleaning system of claim 1, wherein the operating component is the agitator motor and the controller controls the agitator motor upon determining the fluid within the recovery tank has reached the desired level by reducing or prohibiting power to the agitator motor.

11. The cleaning system of claim 1, further comprising a supply tank configured to store a fluid; and a distribution nozzle in fluid communication with the supply tank, the distribution nozzle configured to dispense the fluid onto a surface to be cleaned.

12. The cleaning system of claim 11, further comprising the pump or valve configured to control flow of fluid out of the supply tank;

wherein the operating component is the pump or valve and the controller is further configured to control the pump or valve upon determining the fluid within the recovery tank has reached the desired level.

13. The cleaning system of claim 12, further comprising wherein the controller controls the pump upon determining the fluid within the recovery tank has reached the desired level by prohibiting power to the pump.

14. The cleaning system of claim 12, further comprising wherein the controller controls the valve upon determining the fluid within the recovery tank has reached the desired level by closing the valve.

15. A cleaning system comprising:

a vacuum source;

at least one operating component selected from the group consisting of a pump, a valve, and an agitator motor;

a current sensor configured to sense a current drawn by the vacuum source;

a suction inlet in fluid communication with the vacuum source;

a recovery tank configured to store fluid drawn through the suction inlet from a surface to be cleaned by the vacuum source, the recovery tank comprising an air path in fluid communication with the vacuum source and the suction inlet; and a shutoff float configured to float on a surface of the fluid within the recovery tank and close off the air path when a surface of the fluid within the recovery tank reaches a desired level; and a controller having an electronic processor, the controller configured to:

receive, from the current sensor, a signal indicative of the current drawn by the vacuum source;

determine, based on the current drawn by the vacuum source crossing a threshold, when the fluid within the recovery tank has reached the desired level; and control the operating component upon determining the fluid within the recovery tank has reached the desired level.

16. The cleaning system of claim 15, wherein the controller controls the operating component upon determining the current drawn by the motor has dropped below a predetermined current threshold for a predetermined period of time.

17. The cleaning system of claim 15, wherein the operating component is the agitator motor and the controller controls the agitator motor upon determining the fluid within the recovery tank has reached the desired level by reducing or prohibiting power to the agitator motor.

18. The cleaning system of claim 15, further comprising a supply tank configured to store a fluid; and a distribution nozzle in fluid communication with the supply tank, the distribution nozzle configured to dispense the fluid onto a surface to be cleaned.

19. The cleaning system of claim 18, further comprising the pump or valve configured to control flow of fluid out of the supply tank;

wherein the operating component is the pump or valve and the controller is further configured to control the pump or valve upon determining the fluid within the recovery tank has reached the desired level.

20. The cleaning system of claim 19, further comprising wherein the controller controls the pump upon determining the fluid within the recovery tank has reached the desired level by prohibiting power to the pump.

21. The cleaning system of claim 19, further comprising wherein the controller controls the valve upon determining the fluid within the recovery tank has reached the desired level by closing the valve.

* * * * *